United States Patent [19]

Hilterhaus et al.

[11] Patent Number: 4,980,968

[45] Date of Patent: Jan. 1, 1991

[54] SLIDER-INSTALLING SYSTEM FOR SLIDE-FASTENER MANUFACTURE

[75] Inventors: Reiner Hilterhaus; Reinhard Damaschke, both of Essen; Jörg Geiger, Oberhausen; Kurt Scheid, Dorsten, all of Fed. Rep. of Germany

[73] Assignee: Opti Patent-, Forschungs- und Fabrikations-AG, Riedern-Allmeind, Switzerland

[21] Appl. No.: 387,690

[22] Filed: Jul. 28, 1989

[30] Foreign Application Priority Data

Jul. 28, 1988 [DE] Fed. Rep. of Germany ..... 3825713

[51] Int. Cl.[5] ..... A41H 37/06; B29D 5/00

[52] U.S. Cl. ..... 29/768; 29/766; 29/33.2; 29/408

[58] Field of Search ..... 29/33.2, 408, 409, 766, 29/768, 771, 786; 221/133, 224, 239

[56] References Cited

U.S. PATENT DOCUMENTS 3,575,316 4/1971 Bianchi ..... 221/113
4,310,961 1/1982 Clearwater ..... 29/408
4,361,946 12/1982 Takamatsu ..... 29/408
4,573,264 3/1986 Hatagishi ..... 29/766

*Primary Examiner*—P. W. Echols
*Assistant Examiner*—S. Thomas Hughes
*Attorney, Agent, or Firm*—Herbert Dubno; Andrew Wilford

[57] ABSTRACT

A method of mounting a slider on a workpiece consisting of a pair of parallel and longitudinally extending tapes having confronting edges provided with interleavable coupling elements and formed by removal of sections of the elements to form longitudinally spaced gaps comprises the steps of first feeding the workpiece in a normally forward travel direction along a Z-shaped path having an upstream portion, a middle portion, and a downstream portion. Then the presence of one of the gaps is detected at the middle portion and, when such presence is detected, the workpiece is arrested at the middle portion. The one gap of the arrested workpiece is then spread and thereafter a slider is pushed transversely into the spread gap. The workpiece is then gripped in the upstream portion and pulled backward so as to pull the coupling elements through the slider pushed into the gap. Finally the slider is released to continue forward advance of the workpiece.

1 Claim, 3 Drawing Sheets

6
D
31
9
10
5
32
controller
16
12
11
15
1
3
4
24
7
2
22
1
13
20
8
4
3
1
4
3
14

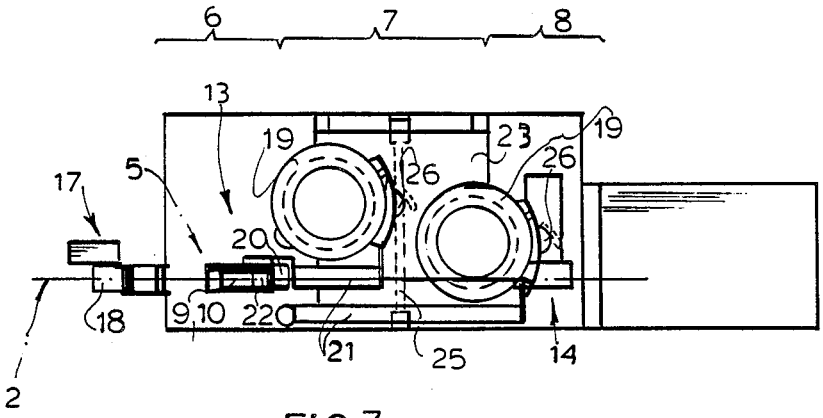
FIG.3
FIG. 4
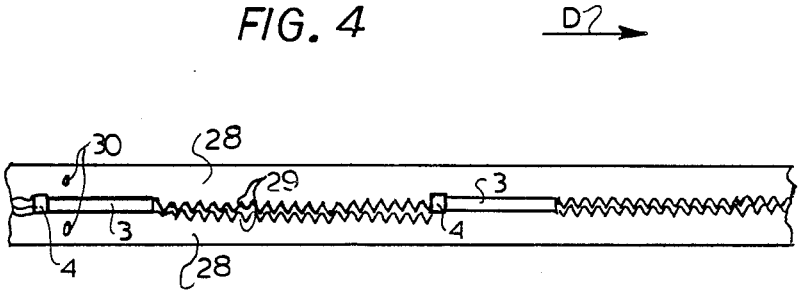

SLIDER-INSTALLING SYSTEM FOR SLIDE-FASTENER MANUFACTURE

SPECIFICATION

1. Field of the Invention

The present invention relates to the manufacture of a slide fastener. More particularly this invention concerns the mounting of a slider on a partially manufactured slide fastener.

2. Background of the Invention

A slide fastener typically is formed by a pair of longitudinally extending and parallel textile tapes having confronting edges that carry interleavable coupling elements. These elements, which are typically made of a synthetic-resin coiled or meandered monofilament, do not extend the full length of the respective tapes and are joined together at their one ends by a so-called bottom end stop and each carry at their opposite ends a so-called top stop. A slide can move along both elements and is constructed such that on longitudinal movement from the bottom stop toward the top stops it interleaves, that is joins, the two coupling elements, and on opposite movement it separates them.

Such fasteners are made as described in commonly assigned and copending patent application No. 07/306,294 filed July 28, 1989 in a mass-production operation starting from a basic workpiece comprised of two very long parallel tapes whose confronting edges carry full-length coupling elements that are usually joined together. In a first machine a gap is formed in the joined coupling elements, same being cut away or otherwise removed for short distances at locations spaced along the tapes by the length of the fasteners to be made. Then the bottom end stops are fitted to the joined coupling elements at what is normally relative to the direction of travel of the tapes the trailing edges of each gap. A slider is then fitted to the elements from the leading edge of each gap, being slid on in a direction tending to separate the elements. Subsequently the top stops are applied to the separated coupling elements immediately downstream of the slider at the leading end of each gap. Finally, the tapes are cut transversely across generally through the center of the gap, separating out the individual fasteners. The finished individual slide fasteners are then bundled together, provided with some sort of wrapping, and labeled for sale.

OBJECTS OF THE INVENTION

It is an object of the present invention to provide an improved system for installing sliders on slide-fastener workpieces.

Another object is the provision of such an improved system for installing sliders on slide-fastener workpieces which operates rapidly, which accommodates different production speeds automatically, and which can be set up to change sliders for different types of fasteners.

SUMMARY OF THE INVENTION

A method of mounting a slider on a workpiece consisting of a pair of parallel and longitudinally extending tapes having confronting edges provided with interleavable coupling elements and formed by removal of sections of the elements to form longitudinally spaced gaps comprises the steps of first feeding the workpiece in a normally forward travel direction along a path having an upstream portion, a middle portion, and a downstream portion. Then the presence of one of the gaps is detected at the middle portion and, when such presence is detected, the workpiece is arrested at the middle portion. The one gap of the arrested workpiece is then spread and thereafter a slider is pushed transversely into the spread gap. The workpiece is then gripped in the upstream portion and pulled backward so as to pull the coupling elements through the slider pushed into the gap. Finally the slider is released to continue forward advance of the workpiece.

Thus with the system of this invention the sliders are installed wholly automatically. The process can easily adapt to a fast or slow travel speed and, since it is the gaps that are detected, it does not need to be readjusted for fasteners of different lengths.

According to a further feature of this invention the workpiece arrives generally continuously at the same speed to the upstream portion. The workpiece is therefore guided through a variable length loop upstream of the upstream portion and the loop is lengthened when the workpiece is pulled backward but otherwise kept at a relatively short length.

The workpiece according to this invention is arrested by engaging an abutment longitudinally with the bottom stop. In addition the system detects when the slider is pushed through the spread gap and aligned longitudinally with the coupling elements and generates an output corresponding to such detection. This output triggers the gripping and backward retraction of the workpiece.

Thus the apparatus of this invention has a sensor at the middle portion for detecting the presence of a one of the gaps and an abutment connected to the sensor means for, when the presence of a gap is detected, arresting the workpiece at the middle portion. A spreading device widens the one gap of the arrested workpiece and a holder pushes a slider transversely into the spread gap. A clamp serves for gripping the workpiece in the upstream portion and pulling it backward so as to pull the coupling elements through the slider pushed into the gap.

The path of this invention is Z-shaped and a controller including a sensor at the middle portion detects insertion of a slider into a one of the gaps and triggers operation of the clamp. Furthermore looper rollers form a variable-length loop in the workpiece upstream of the upstream portion and at least two supplies of different such sliders are employed each having a guide alignable with the holder means for feeding the sliders from the respective supplies to the holder means. These guides can be alternately aligned with the holder means for feeding the respective sliders thereto. The guides are rails and the invention includes means for rapidly emptying the supply.

DESCRIPTION OF THE DRAWING

The above and other objects, features, and advantages will become more readily apparent from the following, reference being made to the accompanying drawing in which:

FIG. 3 is a top view of the apparatus of FIG. 3; and

FIG. 4 is a top view of a slide-fastener workpiece according to this invention.

SPECIFIC DESCRIPTION

Figure 1:
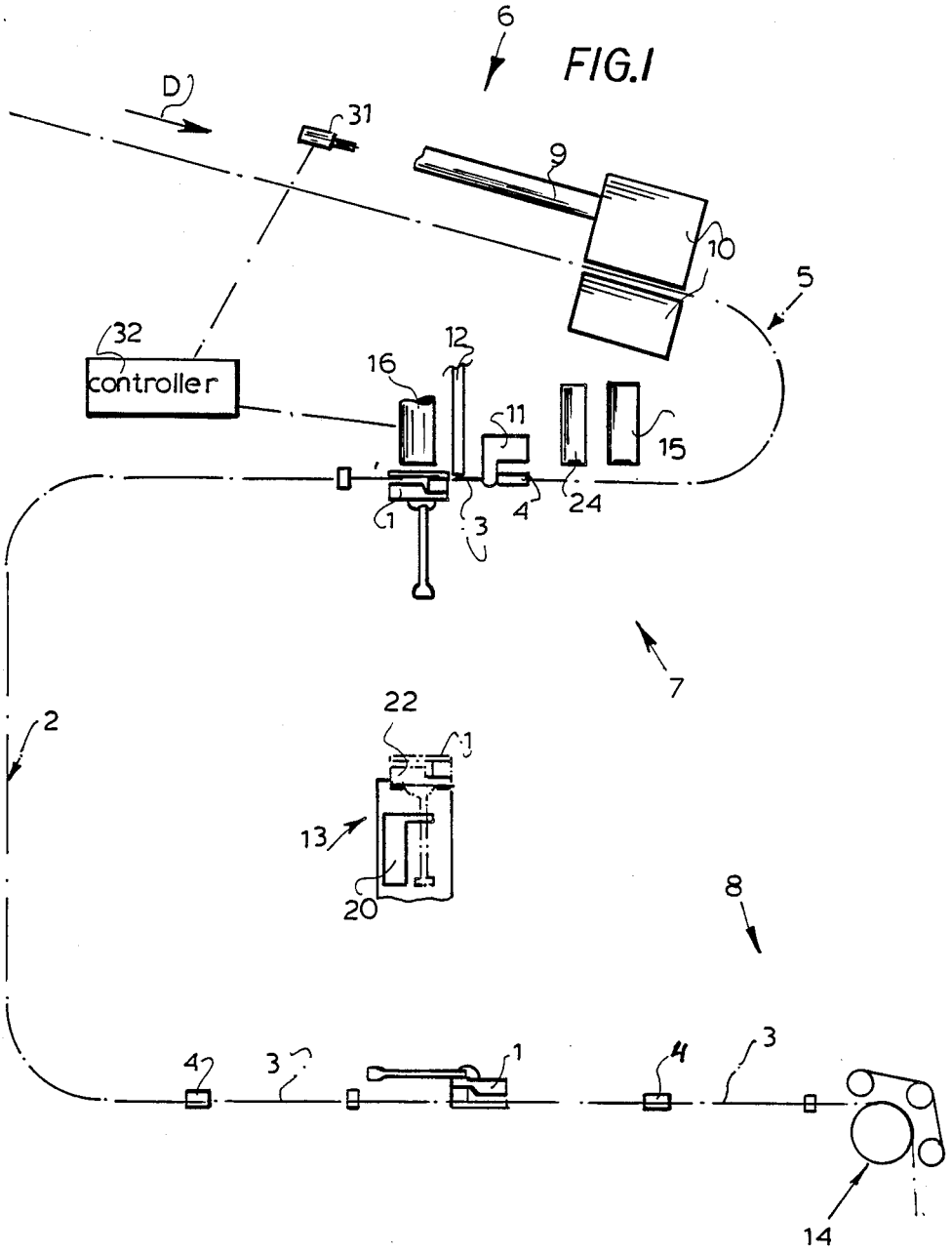
FIG. 1 is a mainly schematic illustration of the system of this invention.

As seen in FIG. 4 a slide-fastener workpiece 2 is formed by a pair of textile tapes 28 having confronting edges provided with interleaved coupling elements 29 that are punched out at longitudinally spaced intervals to form gaps 3. Bottom stops 4 are fixed over the elements 29 at the trailing ends of the gaps 3 and indicia 30 as described in the above-cited commonly assigned patent application are applied adjacent some of the gaps 3.

FIG. 1 shows a system for mounting sliders 1 on the workpiece 2, it being noted that the workpiece 2 is fed in a direction D with the already mounted bottom stop 4 at the leading edge of each stretch of interleaved coupling elements 29. To this end the workpiece 2 is fed through an apparatus 5 defining a Z-shaped path having an upstream portion 6, a reverse-direction middle portion 7, and a downstream portion 8.

A clamp support 9 reciprocal by an actuator 31 in the direction D has closable clamping elements 10 that flank the workpiece 2 in the upstream path portion 6. In the intermediate portion 7 is an abutment finger 11 and spreading pin 12 as well as a sensor 15 for detecting the gaps 3 and another sensor 24 that can detect color- or style-change markings like the marks 30. The actuator 31 as well as the similar but unillustrated actuators for the clamp elements 10 and pin 12 as well as the sensors 15 and 24 are all connected to a controller 32.

Immediately downstream cf the spreader pin 12 is a transversely reciprocal slider holder 13 formed with a seat 22 for a slider 1 and provided with a pusher 20 that can push a slider 1 out of this seat 22. A detector 16 connected to the controller 32 is provided on the opposite side of the workpiece tape 2 to detect the proximity of such a slider 1.

The extreme downstream end of the downstream portion 8 is provided with a workpiece-gripping drive 14 also operated by the controller 32.

Figure 2:
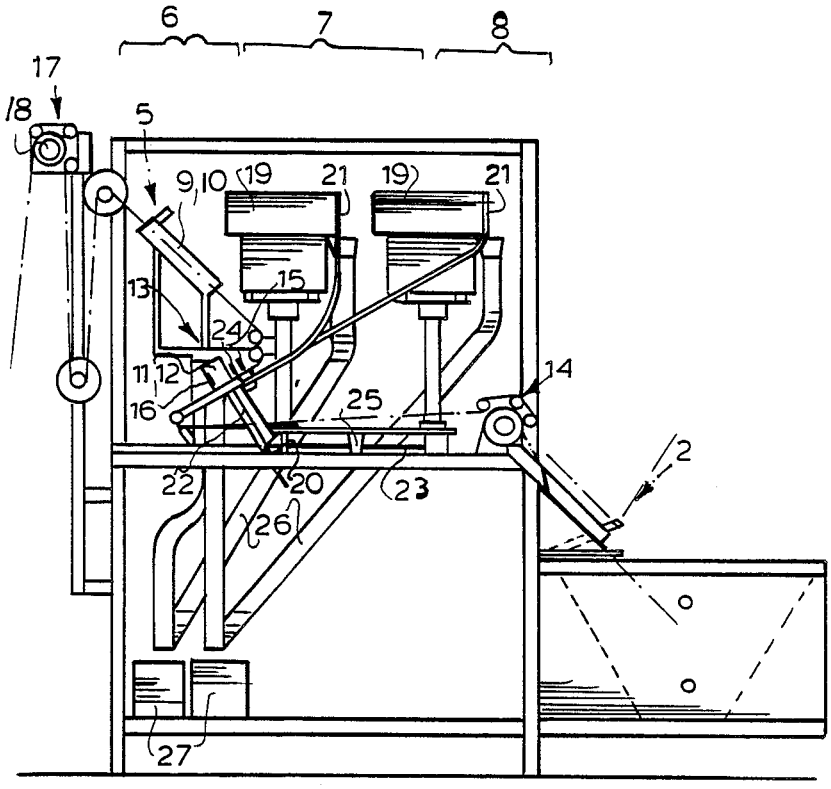
FIG. 2 is a small-scale side view of the apparatus of the present invention.

As seen in FIGS. 2 and 3 upstream of the upstream portion 6 is a looper 17 having a vertically displaceable looper roller 18 movable through a vertical stroke equal to at least half the length of the longest possible fastener the device will manufacture. In addition a pair of slider supplies 19 are carried on a transversely displaceable support plate 23 and have respective feed rails 21 either of which can be aligned with the holder 20 to feed a respective slider 1 thereto. Unused sliders 1 are fed via drop tubes 26 to respective hoppers 27 underneath the device for fast emptying and a drive system 25 operated by the controller 32 is provided for laterally displacing the plate 23.

The apparatus described above operates as follows:

The workpiece 2 is fed to the upstream end of the path through the looper 17 continuously at a generally steady rate. Each time the sensor 15 detects one of the gaps 3 and the abutment finger 11 comes to rest against the downstream end of the respective bottom stop 4, the spreading finger 12 is advanced to open up this gap 3, this action clearly arresting advance of the workpiece 2 so that the roller 18 moves up. Then the holder 20 is advanced by the controller 32 until the slider 1 fitted in its seat 22 is engaged through the gap 3 and is sensed by the sensor 16, whereupon the controller 32 closes the clamp elements 10 and pulls the support 9 therefor back opposite the direction D. This action reverses the displacement of the workpiece 2 and pulls the elements 20 of the workpiece 2 through the slider 1, thereby fitting this slider 1 to the tape workpiece 1, so that the pusher 20 can then push the slider 1 out of the seat. The clamp elements 10 then release so that the roller 18 can move back down and the cycle can be repeated.

When the sensor 24 detects a change in color and/or style of the workpiece 2, the drive 25 pushes the plate 23 to align the feed rail 21 of the other supply 19 with the holder 20. This results in an automatic change of slider, style or color.

We claim:

1. An apparatus for mounting a slider on a workpiece consisting of a pair of parallel and longitudinally extending tapes having confronting edges provided with interleavable coupling elements and formed by removal of sections of the elements and mounting of bottom stops to form longitudinally spaced gaps each having a trailing edge at a respective bottom stop, the apparatus comprising:

structure defining a Z-shaped path having an upstream portion, a reverse-direction middle portion, and a downstream portion;

guides forming a variable-length loop in the tapes upstream of the upstream portion;

sensor means at the middle portion for detecting the presence of one of the gaps;

abutment means connected to the sensor means for, when the presence of a gap is detected, arresting the tapes at the middle portion by engagement with the respective bottom stop;

means for spreading the gap of the arrested tapes;

holder means for pushing a slider transversely into the spread gap;

at least two supplies of different such sliders;

a common slide support carrying both supplies and movable between a pair of end positions;

means including respective guide rails fixed on the support, extending from the supplies, and alignable with the holder means in the respective end positions of the support for feeding the sliders from the respective supplies to the holder means;

means connected to the support for aligning the guide rails alternately with the holder means for feeding the respective sliders thereto;

means including a sensor for detecting indicia on one of the tapes and connected to the aligning means for shifting the slide support to change slide supplies on detection of predetermined indicia;

clamp means for gripping the tapes in the upstream portion and pulling them backward so as to pull the coupling elements through the slider pushed into the gap; and control means including a sensor at the middle portion for detecting insertion of a slider pushed into one of the gaps and triggering operation of the clamp means.

* * * * *